United States Patent [19]

Schmode et al.

[11] Patent Number: 4,795,377

[45] Date of Patent: Jan. 3, 1989

[54] CLAMPING ARRANGEMENT FOR ELECTRIC CONDUCTORS

[75] Inventors: Hartmut Schmode, Blomberg; Peter Krüger; Manfred Wilmes, both of Detmold, all of Fed. Rep. of Germany

[73] Assignee: C. A. Weidmueller GmbH & Co., Detmold, Fed. Rep. of Germany

[21] Appl. No.: 128,071

[22] Filed: Dec. 3, 1987

[30] Foreign Application Priority Data

Dec. 16, 1986 [EP] European Pat. Off. ..... 86117489.4

[51] Int. Cl.[4] ..... H01R 9/10

[52] U.S. Cl. ..... 439/727; 439/728; 439/729; 439/812; 439/811

[58] Field of Search ..... 439/726, 727, 728, 729, 439/771, 772, 774, 775, 810, 811, 812, 806, 807

[56] References Cited

U.S. PATENT DOCUMENTS

| | | | |
|---|---|---|---|
| 2,718,626 | 9/1955 | Benarder | 439/729 X |
| 3,562,701 | 2/1971 | Orr | 439/811 X |
| 4,077,696 | 3/1978 | Glaesel | 439/806 X |
| 4,171,152 | 10/1979 | Geiseler | 439/811 X |
| 4,331,377 | 5/1982 | Ebbinghaus et al. | 439/811 X |
| 4,629,281 | 12/1986 | Krüger | 439/812 |
| 4,693,542 | 9/1987 | Heng et al. | 439/810 X |

FOREIGN PATENT DOCUMENTS

| | | | |
|---|---|---|---|
| 736802 | 6/1943 | Fed. Rep. of Germany | 439/811 X |
| 1107755 | 5/1961 | Fed. Rep. of Germany | 439/811 X |
| 2500141 | 7/1975 | Fed. Rep. of Germany | 439/811 X |
| 2357091 | 9/1976 | Fed. Rep. of Germany | 439/812 X |
| 2537469 | 3/1977 | Fed. Rep. of Germany | 439/811 X |
| 2911972 | 10/1980 | Fed. Rep. of Germany | 439/810 X |
| 456714 | 7/1968 | Switzerland | 439/811 X |
| 2069775 | 8/1981 | United Kingdom | 439/811 X |

*Primary Examiner*—William L. Sikes
*Assistant Examiner*—Brian M. Healy
*Attorney, Agent, or Firm*—Laubscher & Laubscher

[57] ABSTRACT

An arrangement for clamping an electric conductor includes a clamping cage having a threaded bore centered on a central axis. A clamping screw is received in the threaded bore for threading in and out along a predetermined path centered on the central axis. An insertion receptacle for the electric conductor is accommodated in the clamping cage and extends substantially parallel to the central axis. A pressure member is mounted in the clamping cage for pivoting about a pivot axis out of and back into an open position thereof and extends into the predetermined path. A spring urges the pressure member toward its open position. The spring is an integral unitary portion of the clamping cage and extends from an outer contour of the clamping cage towards the pressure member.

4 Claims, 1 Drawing Sheet

CLAMPING ARRANGEMENT FOR ELECTRIC CONDUCTORS

BACKGROUND OF THE INVENTION

The present invention relates to clamping arrangements in general, and more particularly to a clamping arrangement for electric conductors, especially for wires and cables.

There are already known various constructions of clamping arrangements of the above type, among them such which include a clamping cage having a threaded bore centered on a central axis, wherein a clamping screw is received in the threaded bore for threading in and out along a predetermined path centered on the central axis, wherein an insertion receptacle for the electric conductor extends substantially parallel to the central axis, wherein a pressure member is mounted in the clamping cage for pivoting about a pivot axis out of and back into an open position thereof and extending into the predetermined path, and wherein a spring urges the pressure member toward its open position.

One clamping arrangement of this type is known, for instance, from the German patent No. 23 57 091. It is true that this particular clamping arrangement already includes a spring which assures that the clamping member is guided and can also be returned into its open position. However, the clamping arrangement of this known construction has an important disadvantage which resides in the fact that a separate spring must be provided and manipulated into its proper position in the interior of the clamping cage. This not only is space-consuming, but also results in a complicated assembly of a clamping arrangement of this kind.

SUMMARY OF THE INVENTION

Accordingly, it is a general object of the present invention to avoid the disadvantages of the prior art.

More particularly, it is an object of the present invention to provide a clamping arrangement which does not possess the drawbacks of the known arrangements of this type.

Still another object of the present invention is to devise an arrangement of the type here under consideration which has a much lower space consumption than known arrangements of this type.

A concomitant object of the present invention is so to construct the arrangement of the above type as to be relatively simple in construction, inexpensive to manufacture, easy to use, and yet reliable in operation.

In keeping with these objects and others which will become apparent hereafter, one feature of the present invention resides in an arrangement for clamping an electric conductor, which arrangement includes a clamping cage having a threaded bore centered on a central axis; a clamping screw received in the threaded bore for threading in and out along a predetermined path centered on the central axis; an insertion receptacle for the electric conductor, extending substantially parallel to the central axis; a pressure member mounted in the clamping cage for pivoting about a pivot axis out of and back into an open position thereof and extending into the predetermined path; and a spring urging the pressure member toward the open position thereof, the spring being an integral unitary portion of the clamping cage and extending from an outer contour of the clamping cage towards the pressure member.

A particular advantage of the above-described construction of the clamping arrangement of the present invention is that the manufacture of such an arrangement is significantly simplified due to the fact that the mounting in the interior of the clamping cage of a separate spring for the return of the clamping member into its open position is dispensed with. Yet, on the other hand, the manufacture of the clamping cage is only very insignificantly complicated by the formation of the spring thereon, especially since such clamping cages are usually constructed as stamped-out and bent parts, on which the additional formation of the spring can be achieved in a very simple manner. The arrangement is also extremely space-saving, inasmuch as the spring is no longer situated in the internal receiving space of the clamping cage; rather, it is guided to the pressure member from the outer contour of the clamping cage where, as a result of the system structure, a sufficient amount of space is always available.

In accordance with a particularly advantageous aspect of the present invention, the pressure member is constituted by an elongated lever which is oriented substantially parallel to the central axis at least in the open position thereof. Then, the spring extends substantially parallel to the lever and has a free end portion that extends at an angle with respect to the remainder of the spring and reaches around and behind the pressure member. Owing to this particular construction, the clamping arrangement is especially small-sized and compact, inasmuch as it is possible to arrange the insertion receptacle, the clamping screw, the pressure member and the spring especially close to one another.

It is particularly advantageous when, according to the present invention, the aforementioned lever is a two-arm lever, when a pivot that is centered on the pivot axis mounts the two-arm lever for pivoting on the clamping cage, when the two-arm lever has a pressure zone at which it is engaged by the clamping screw, an action zone at which it engages the electric conductor, and a contact zone at which it is contacted by the spring, and when the pressure zone and the action zone are situated at one and the same side of the pivot, while the contact zone is arranged at the opposite size of the pivot. Even this structural implementation contributes to a particularly compact, space-saving construction and, in addition thereto, has a further significant advantage that the clamping of the electric conductor is accomplished, for all intents and purposes, in a direct force-transmitting path between the active end of the clamping screw, the pressure member, the electric conductor, and the corresponding reaction member provided for the electric conductor on the clamping cage, especially without a direct interposition or involvement of the spring, whose force is applied only at a corresponding lever arm relative to the pivoting axis. As a direct consequence of this, any influence of the spring on the clamping operation is advantageously practically eliminated even in clamping arrangements of the above construction which have relatively large dimensions.

According to a further advantageous facet of the present invention, the clamping cage has a region that is provided with the threaded bore for the clamping screw, and the spring is formed on and integral with this region of the clamping cage.

BRIEF DESCRIPTION OF THE DRAWING

The present invention will be described below in more detail with reference to the accompanying drawing in which.

DETAILED DESCRIPTION OF THE PREFERRED EMBODIMENT

Figure 1:
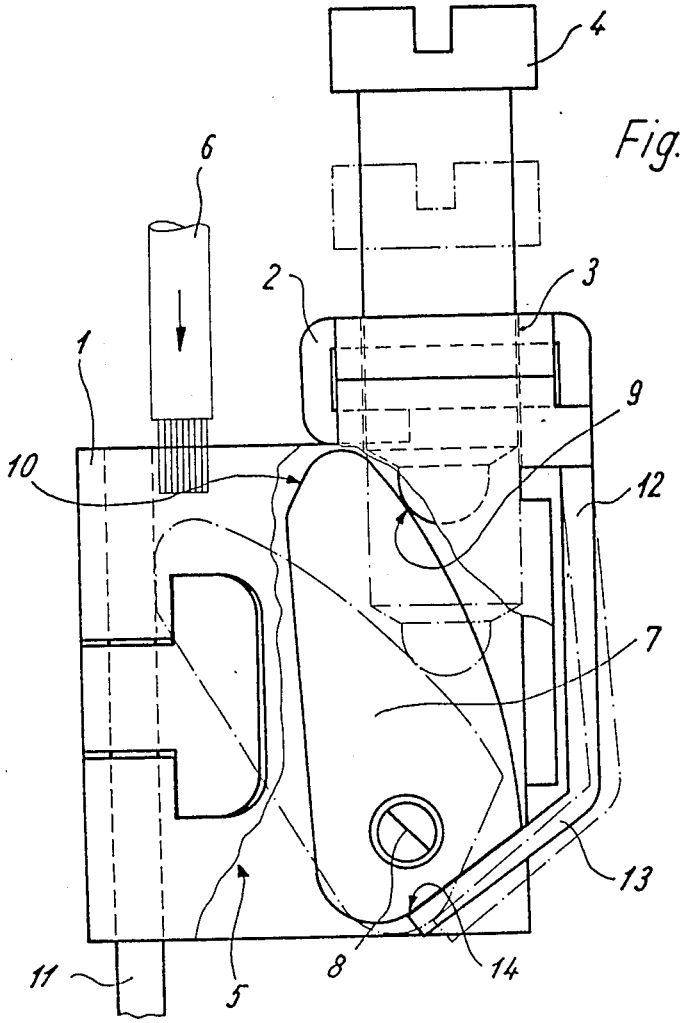
FIG. 1 is a partially broken-away side elevational view of a clamping arrangement of the present invention, with indications of various positions of the active elements of the arrangement.
Figure 2:
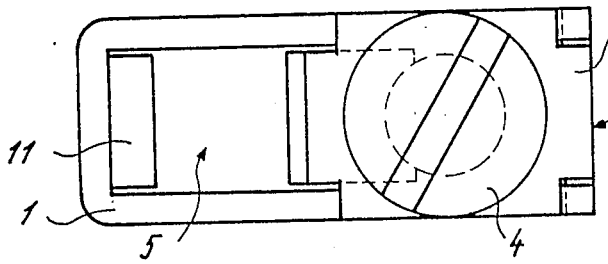
FIG. 2 is a top plan view of the clamping arrangement of FIG. 1.

Referring now to the drawing in detail, and first to FIG. 1 thereof, it may be seen that the reference numeral 1 has been used therein to identify a clamping cage of a clamping arrangement of the present invention. The clamping cage 1 is a part that is produced in a well-known manner by punching and bending out of sheet metal material. The thus obtained sheet metal blank is formed on its upper region with an overlapping portion 2 that is provided with a threaded bore 3, into which there is threaded a clamping screw 4. It is to be mentioned that all references made herein to various directions are to be understood with respect to the position which the clamping arrangement assumes in FIG. 1 of the drawing and which not necessarily coincides with the position that the clamping arrangement assumes when in use.

In the clamping cage 1, there is formed an insertion receptacle 5 for an electric conductor 6 which is to be introduced into and secured in position in the insertion receptacle 5. For the securing of the inserted electric conductor 6 in position, there is provided a pressure member 7 which is located in the clamping cage 1 and mounted on the latter for pivoting movement. In the illustrated exemplary embodiment of the present invention, the pressure member 7 is constituted by an elongated lever, particularly by a two-arm lever, which is pivotable about a pivoting axis of a pivot 8 that is situated at the lower region of the clamping cage 1, that is, at a region of the clamping cage 1 that is remote from the overlapping portion 2 with its threaded bore 3 for the clamping screw 4.

The pressure member 7 is acted upon by a lower acting end of the clamping screw 4 during the tightening of the latter along an action zone 9. Inasmuch as the pressure member 7 is elongated and is oriented substantially parallel to the insertion receptacle 55 of the clamping cage 1, a pressure zone 10 of the pressure member 7 immediately and directly presses the inserted electric conductor 6 against a reaction member 11, such as a current-conducting rail section, which is situated in the clamping cage 1. As a result of the fact that the action zone 9 of the pressure member 7 can be situated at a relatively large distance from the axis of the pivot 8, there is obtained an excellent pressing of the electric conductor 6 against the reaction member 1 even when the axial force exerted by the clamping screw 4 is relatively small and even when the axis of the clamping screw 4 is offset by only a relatively small transverse distance with respect to the axis of the pivot 8.

For the forced guidance of the pressure member 7 that is dependent on the position of the clamping screw 4, and particularly for an automatic return displacement of the pressure member 7 into its open position for facilitating the insertion of the electric conductor 6 into the insertion receptacle 5, there is provided a spring 12 which is formed, in a structurally simple manner, directly on the clamping cage 1. More particularly, the spring 12 is advantageously formed, in the exemplary embodiment of the present invention that is shown in the drawing, on the upper overlapping portion 2 of the clamping cage 1 which is provided with the threaded bore 3 for the clamping screw 4. Herein, the spring 12 extends from the outer contour of the clamping cage toward and into contact with the pressure member 7.

It is particularly advantageous in this construction when the spring 12 first extends from the upper region at which it is formed on and connected to the overlapping portion 2 in a direction substantially parallel to the longitudinal direction of the elongated pressure member 7, whereafter it continues in a free end portion 13 that extends along a course that includes an obtuse angle with respect to that of the remainder of the spring 12, so that this free end portion 13 of the spring 12 engages the pressure member 7 from below. In this manner, it is achieved that a contact zone 14 of the pressure member 7 with the spring 12 is located at the opposite side of the pivot 8 than the pressure zone 9 of the clamping member 7 for the clamping screw 4 and also than the action zone 10 of the clamping member 7 for the electric conductor 6 to be attached. In the course of the clamping of the electric connector 6 to be attached, this means a direct positive connection commencing with the corresponding active end of the clamping screw 4, continuing through the upper part of the pressure member 7, then even through the electric conductor 6, and then terminating at the reaction member 11, such as the aforementioned current-conducting rail section. This direct connection is achieved in particular to the exclusion of the spring 12 from the force train.

In the course of pivoting of the pressure member 7 in the sense of clamping the electric conductor 6, the spring 12 is moved slightly outwardly and thus away from the pivot 8 by the end region of the pressure member 7 which is remote from and opposite to the clamping region 9, with attendant commensurate stressing of the spring 12. This slight stressing, also coupled with the relatively large length of the course along which the spring 12 extends parallel to the pressure member 7, is completely sufficient, in connection with the lever arm which is present between the contact zone 14 and the axis of the pivot 8, to cause the pressure member 7 to follow the clamping screw 4 during its unthreading all the way to its open position, with simultaneous release of the electric conductor 6.

While the present invention has been described and illustrated herein as embodied in a specific construction of a clamping arrangement for electric conductors, especially wires, it is not limited to the details of this particular construction, since various modifications and structural changes are possible and contemplated by the present invention. Thus, the scope of the present invention will be determined exclusively by the appended claims.

What is claimed is:

1. An arrangement for clamping an electric conductor, comprising a clamping cage having a threaded bore centered on a central axis;

a clamping screw received in said threaded bore for threading in and out along a predetermined path centered on said central axis;

an insertion receptacle for the electric conductor, extending substantially parallel to said central axis;

a pressure member mounted in said clamping cage for pivoting about a pivot axis out of and back into an open position thereof and extending into said predetermined path; and a spring urging said pressure member toward said open position thereof, said spring being an integral unitary portion of said clamping cage and extending from an outer contour of said clamping cage towards said pressure member.

2. The clamping arrangement as defined in claim 1, wherein said pressure member is an elongated lever which is oriented substantially parallel to said central axis at least in said open position thereof; wherein said spring extends substantially parallel to said lever; and wherein said spring has a free end portion that extends at an angle with respect to the remainder of said spring and reaches around and behind said pressure member.

3. The clamping arrangement as defined in claim 2, wherein said lever is a two-arm lever; further comprising a pivot centered on said pivot axis and mounting said two-arm lever for pivoting on said clamping cage; wherein said two-arm lever has a pressure zone at which it is engaged by said clamping screw, an action zone at which it engages the electric conductor, and a contact zone at which it is contacted by said spring; and wherein said pressure zone and said action zone are situated at one and the same side of said pivot, while said contact zone is arranged at the opposite size of said pivot.

4. The clamping arrangement as defined in claim 1, wherein said clamping cage has a region that is provided with said threaded bore for said clamping screw; and wherein said spring is formed on and integral with said region of said clamping cage.

* * * * *